US009850430B2

(12) United States Patent
Meyer

(10) Patent No.: US 9,850,430 B2
(45) Date of Patent: Dec. 26, 2017

(54) METHOD AND SYSTEM FOR UTILIZING SELECTIVELY DE-COUPLEABLE CONNECTIONS FOR MODULAR INSTALLATION OF A COKE DRUM

(71) Applicant: Foster Wheeler USA Corporation, Houston, TX (US)

(72) Inventor: William Meyer, Sugar Land, TX (US)

(73) Assignee: AMEC Foster Wheeler USA Corporation, Houston, TX (US)

( * ) Notice: Subject to any disclaimer, the term of this patent is extended or adjusted under 35 U.S.C. 154(b) by 766 days.

(21) Appl. No.: 14/204,825

(22) Filed: Mar. 11, 2014

(65) Prior Publication Data

US 2014/0262731 A1 Sep. 18, 2014

Related U.S. Application Data

(60) Provisional application No. 61/778,112, filed on Mar. 12, 2013.

(51) Int. Cl.
*C10B 1/04* (2006.01)
*C10B 55/00* (2006.01)

(52) U.S. Cl.
CPC ..... *C10B 1/04* (2013.01); *C10B 55/00* (2013.01)

(58) Field of Classification Search
CPC ..... C10B 1/04; C10B 55/00
See application file for complete search history.

(56) References Cited

U.S. PATENT DOCUMENTS 4,207,062 A * 6/1980 Moench ..... E01C 19/1036 366/25
4,726,109 A 2/1988 Malsbury et al.
4,960,358 A * 10/1990 DiGiacomo ..... C10B 25/10 202/241
5,082,534 A * 1/1992 Breu ..... C10B 1/10 201/32
5,947,674 A * 9/1999 Malsbury ..... C10B 33/00 202/241
7,871,500 B2 * 1/2011 Lah ..... C10B 1/04 202/266

(Continued)

FOREIGN PATENT DOCUMENTS

EP 0 590 902 A1 4/1994

OTHER PUBLICATIONS

PCT International Search Report, International Application No. PCT/US2014/024899, Jul. 8, 2014.

*Primary Examiner* — Jonathan Miller
(74) *Attorney, Agent, or Firm* — Winstead PC

(57) ABSTRACT

In one aspect, the present invention relates to a coke drum module, the coke drum module includes a support frame. A coke drum is disposed within the support frame. A strut is removably connected to the support frame and the coke drum. The strut becomes unloaded responsive to the coke drum contacting a support pad. The coke drum module further includes a compression member removably connected to the support frame and the coke drum. The compression member is oriented generally perpendicularly to the strut. A rigid connection is present between the coke drum and the support frame during transportation of the coke drum module. Upon removal of the strut and the compression member, the rigid connection is not present.

16 Claims, 7 Drawing Sheets

(56) References Cited

U.S. PATENT DOCUMENTS

| | | | | |
|---|---|---|---|---|
| 8,905,260 | B2 * | 12/2014 | Samman | C10B 1/04 220/480 |
| 2007/0076836 | A1 | 4/2007 | Fortier | |
| 2007/0215452 | A1 | 9/2007 | Cihlar et al. | |
| 2009/0183980 | A1 | 7/2009 | Lah | |

* cited by examiner

METHOD AND SYSTEM FOR UTILIZING SELECTIVELY DE-COUPLEABLE CONNECTIONS FOR MODULAR INSTALLATION OF A COKE DRUM

CROSS-REFERENCE TO RELATED APPLICATIONS

This application claims priority to, and incorporates by reference, for any purpose, the entire disclosure of, U.S. Provisional Patent Application No. 61/778,112, filed Mar. 12, 2013.

BACKGROUND

Field of the Invention

The present application relates generally to coking systems and more particularly, but not by way of limitation, to coking systems utilizing methods and systems for selective connection to a support frame, and, further in particular, but not by way of limitation, to a coke drum module with selectively de-coupleable connections between a coke drum and a support frame.

History of the Related Art

Coke drum systems are frequently utilized in production of petroleum products such as, for example, gasoline, diesel fuel, fuel oil, and other similar products. A coke drum system typically includes a support pad or table top having a support structure constructed there-above. A coke drum is disposed within the support structure. The coke drum is laterally unrestrained except at its support base ring and is vertically supported by the support pad. The coke drum is typically an enclosed metallic vessel often weighing on the order of several hundred tons. During operation, fluids enter the coke drum at high temperatures and induce thermal expansion of the coke drum. Due to the size of the coke drum, such thermal expansion is often in the range of 4-6 inches. Further, movement of the fluids within the coke drum results in uneven heating of the coke drum and non-uniform thermal expansion of the coke drum. It is common for the coke drum to bend to one side and assume a curved banana-like shape. For this reason, there is minimal structural interconnection between the coke drum and the support structure so as to allow room for thermal expansion and contraction of the coke drum without damaging coke drum or the support structure.

During construction of a coke drum system, considerable time is consumed by construction, placement, and securement of the coke drum, the support structure, and associated piping and materials. The coke drum is often lifted in one piece and placed on the support pad prior to completion of the support structure. To accomplish this, lifting trunnions are typically welded or otherwise attached to an exterior surface of the coke drum. The lifting trunnions provide attachment points for requisite lifting rigging. The coke drum is then lifted and moved into position on the support pad. Locations on the coke drum where the lifting trunnions attach are often exposed to thermal expansion stresses and, thus, if the lifting trunnions remain fixed to the coke drum, introduce unnecessary stresses to the coke drum during operation. Once the coke drum is placed onto the support pad, the lifting trunnions are removed via flame cutting or another similar process. Removal of the lifting trunnions is a time-consuming process that may result in damage to the coke drum. For example, flame cutting of the lifting trunnions has resulted in accidental breach of a coke drum exterior necessitating extensive repairs to the coke drum.

When the support structure is constructed, there are no rigid structural connections between the coke drum and the support structure thus allowing thermal expansion and contraction of the coke drum during operation.

SUMMARY

The present application relates generally to coking systems and more particularly, but not by way of limitation, to coking systems utilizing a modular coke drum having selectively rigid and non-rigid connections to a support frame. In one aspect, the present invention relates to a coke drum module having a coke drum disposed within a support frame. A removable strut is disposed in the support frame for supporting a weight of the coke drum in at least one of a horizontal direction and a vertical direction. Tension is at least partially relieved from the removable strut responsive to the coke drum contacting a support pad. Upon removal of the removable strut, the coke drum is not rigidly connected to the support frame thereby facilitating thermal expansion of the coke drum within the support frame.

In another aspect, the present invention relates to a method of installing a coke drum module. The method includes receiving the coke drum module comprising a coke drum and a support frame. A rigid connection is present between the coke drum and the support frame during transportation of the coke drum module. The method also includes lifting the coke drum module and turning the coke drum module such that the coke drum is vertically oriented. Responsive to the coke drum contacting a support pad, a strut coupled to the coke drum and the support frame is at least partially unloaded. The method also includes positioning the support frame on the support pad and removing the strut such that the rigid connection is not present after installation of the coke drum module.

In another aspect, the present invention relates to a coke drum module having a support frame and a coke drum disposed within the support frame. The coke drum is connected to the support frame via a selectively de-coupleable connection. When coupled, selectively de-coupleable connection facilitates transport of the coke drum module. When de-coupled, thermal expansion of the coke drum is facilitated.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
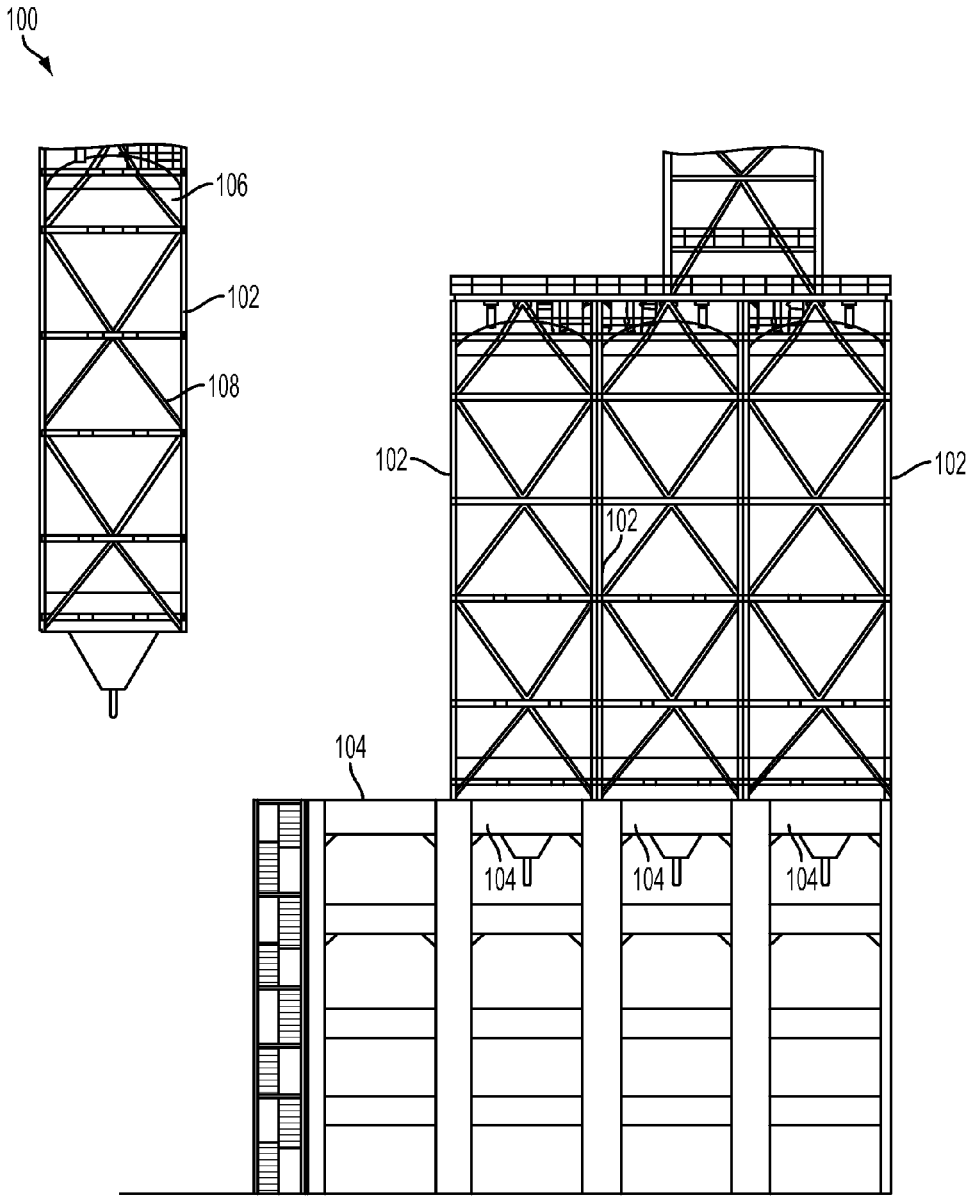
FIG. 1 is a schematic diagram of a coke drum system according to an exemplary embodiment.

FIG. 1 is a schematic diagram of a coke drum system according to an exemplary embodiment. A coke drum system 100 includes a coke drum module 102 placed upon a support pad 104. The coke drum module 102 includes a coke drum 106 placed inside a support frame 108. In a typical embodiment, the coke drum module 102 allows modular construction of a system such as, for example, the coke drum system 100. In such an arrangement, the coke drum 106 and the support frame 108 are constructed, delivered, and installed as an integral unit. Thus, a rigid connection is present between the coke drum 106 and the support frame 108 during transportation of the coke drum module 102. However, after installation of the coke drum module 102, no rigid connection is present between the coke drum 106 and the support frame 108 thus allowing thermal expansion and contraction of the coke drum 106. By way of example, the coke drum system 100 illustrated in FIG. 1 shows four coke drum modules 102 and four support pads 104. However, in other embodiments, coke drum systems utilizing principles of the invention may include any number of coke drum modules and any number of support pads.

Figure 2:
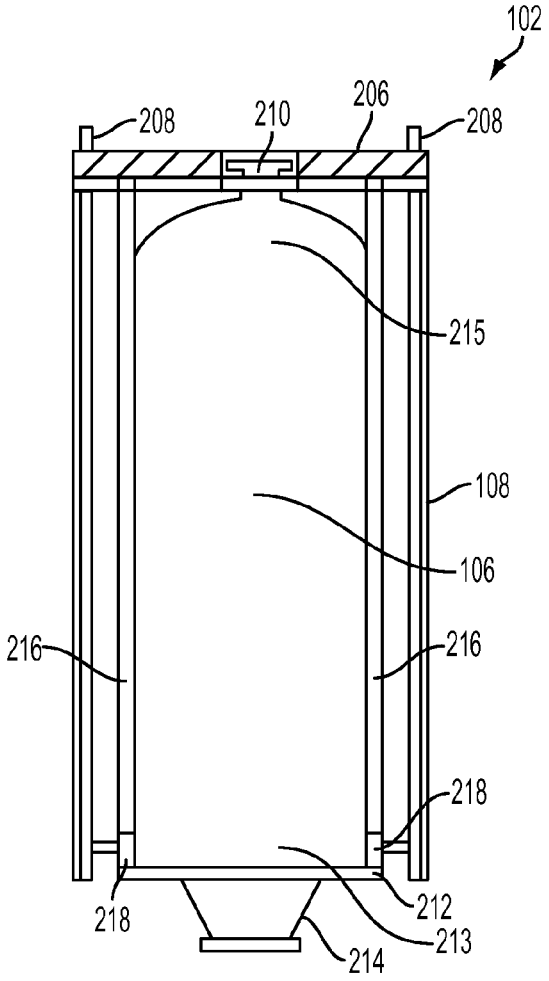
FIG. 2 is a side view of a coke drum module according to an exemplary embodiment.

FIG. 2 is a side view of a coke drum module according to an exemplary embodiment. In a typical embodiment, the coke drum module 102 may be oriented in at least one of a horizontal (transport) position and a vertical (operating) position. The coke drum module 102 includes the coke drum 106 placed inside the support frame 108. A cone 214 extends from a bottom region 213 of the coke drum 106 and a nozzle 210 extends from a top region 215 of the coke drum 106. A skirt ring 212 is secured around a perimeter of the coke drum 106 proximate to the cone 214. A flange 218 is disposed on and connected to the skirt ring 212. In a typical embodiment, the flange 218 is attached to the skirt ring 212 through a process such as, for example, welding, brazing, bolting, or other appropriate process. However, in other embodiments, the flange 218 may be integral with the skirt ring 212. A strut 216 connects the flange 218 to the support frame 108.

The support frame 108 includes a header assembly 206 disposed above the coke drum 106. In a typical embodiment, the header assembly 206 captures and supports the nozzle 210 of the coke drum 106. When the coke drum module 102 is in the vertical (operating) position, a weight of the coke drum 106 is distributed between the strut 216 and the header assembly 206. A first set of lifting lugs 208 are secured to the support frame 108. In a typical embodiment, the first set of lifting lugs 208 allow the coke drum module 102 to be lifted and manipulated during assembly and installation without attachment of lifting trunnions to the coke drum 106. As shown in FIG. 2, the strut 216 is connected to the header assembly 206; however, in other embodiments, the strut 216 may be connected to the support frame 108 at any point. The strut 216 is also designed to support tensile and compressive forces with the coke drum module 102 is in the horizontal (transport) position.

Figure 3:
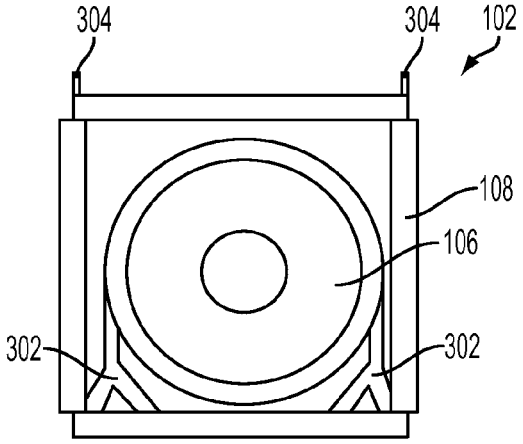
FIG. 3 is an end view of the coke drum module of FIG. 2 according to an exemplary embodiment.

FIG. 3 is an end view of the coke drum module of FIG. 2 according to an exemplary embodiment. Referring to FIGS. 2-3, a compression member 302 connects the flange 218 to the support frame 108. As shown in FIG. 3, the compression member 302 is oriented generally perpendicularly to the strut 216. When the coke drum module 102 is oriented in the horizontal (transport) position, the compression member 302 is positioned below the coke drum 106. Thus, in a typical embodiment, when the coke drum module 102 is in the horizontal (transport) position, the weight of the coke drum 106 is distributed between the header assembly 206 and the compression member 302. A second set of lifting lugs 304 is attached to the support frame 108. In a typical embodiment, the second set of lifting lugs 304 allows the coke drum module 102 to be lifted and oriented during installation and assembly without attachment of lifting trunnions to the coke drum 106.

Figure 4B:
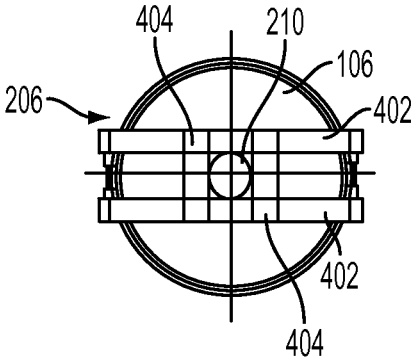
FIG. 4B is a top view of the nozzle region of FIG. 4A according to an exemplary embodiment.
Figure 4A:
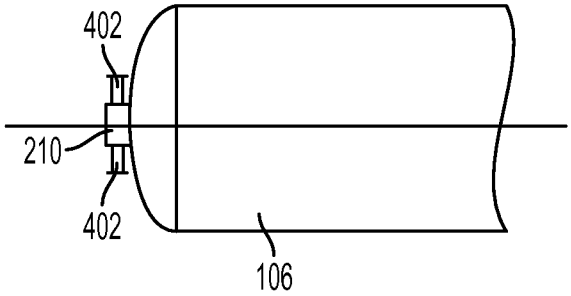
FIG. 4A is a side view of a nozzle region of a coke drum module according to an exemplary embodiment.

FIG. 4A is a side view of a nozzle region of a coke drum module according to an exemplary embodiment. FIG. 4B is a top view of the nozzle region of the coke drum module according to an exemplary embodiment. Referring to FIGS. 4A and 4B, the header assembly 206 includes a pair of header beams 402. The pair of header beams 402 are positioned on opposite sides of the nozzle 210. A pair of cross members 404 are positioned generally perpendicularly to the pair of header beams 402 on opposite sides of the nozzle 210. In a typical embodiment a collar (not explicitly shown) is placed around an exterior circumference of the nozzle 210.

The collar includes a bearing surface (not explicitly shown), which engages the pair of header beams 402 and the pair of cross members 404. In a typical embodiment, the bearing surface is constructed of a low-friction material such as, for example, Teflon or other similar material. The collar and the bearing surface prevent damage to the nozzle 210 due to impact with the pair of header beams 402 and the pair of cross members 404. During operation, the collar and the bearing surface are removed after the coke drum module 102 is installed on the support pad 104 (shown in FIG. 1). Removal of the collar and the bearing surface creates a gap between the nozzle 210, the pair of header beams 402, and the pair of cross members 404. In a typical embodiment, the gap allows sufficient space for movement of the coke drum 106 due to thermal expansion and contraction. Referring to FIGS. 1-4B, during transportation, the coke drum 106 is supported by the strut 216, the compression member 302, and the header assembly 206. The header assembly 206, the strut 216, and the compression member 302 restrict movement of the coke drum 106 relative to the support frame 108 so as to prevent damage to the coke drum 106 during transportation.

Figure 5A:
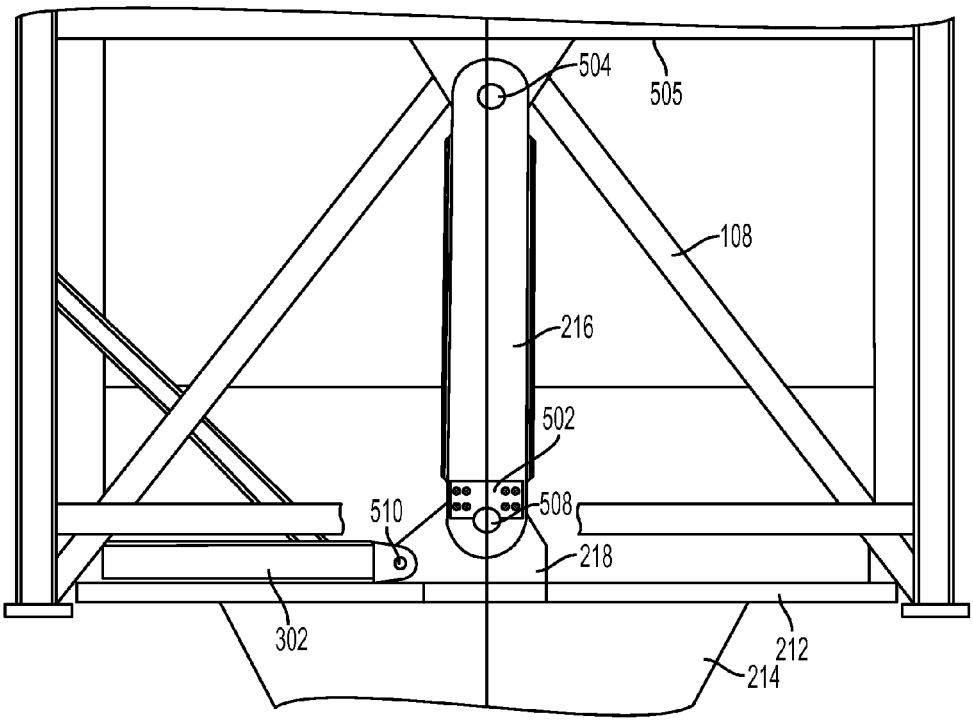
FIG. 5A is a side view of a skirt and cone region of a coke drum module according to an exemplary embodiment.

FIG. 5A is a side view of a skirt and cone region of a coke drum module according to an exemplary embodiment. The cone 214 extends below the skirt ring 212 and the support frame 108. A first pin 508 connects the flange 218 to the strut 216 and a second pin 504 connects the strut 216 to the support frame 108. As shown in FIG. 5A, the strut 216 is coupled to the support frame 108 near a first cross beam 505. However, in other embodiments, coke drum modules utilizing principles of the invention may include struts that couple to the support frame 108 at any point including, for example, at or near the header assembly 206. A keeper plate 502 is removably secured to the strut 216 above the first pin 508. In a typical embodiment, the keeper plate 502 prevents movement of the first pin 508 relative to the strut 216 and, thus, creates a rigid connection between the coke drum 106 and the support frame 108. Such a rigid connection prevents movement and damage of the coke drum 106 relative to the support frame 108 during transportation of the coke drum module 102. A third pin 510 connects the flange 218 to the compression member 302. As shown in FIG. 5A, the coke drum module 102 is oriented in the vertical (operating) position. In a typical embodiment, rotation of the coke drum module 102 from the horizontal (transport) position to the vertical (operating) position transfers the weight of the coke drum 106 from the compression member 302 to the strut 216. Such transfer of the weight of the coke drum 106 unloads the compression member 302.

Figure 5C:
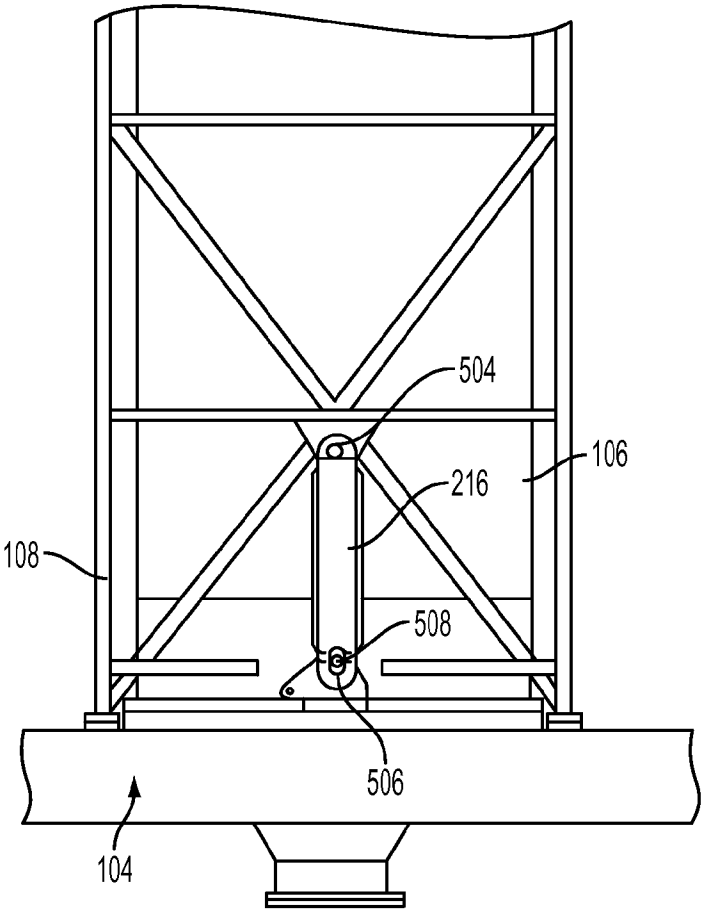
FIG. 5C is a side view of the skirt and cone region of FIG. 5A showing placement on a support pad according to an exemplary embodiment.
Figure 5B:
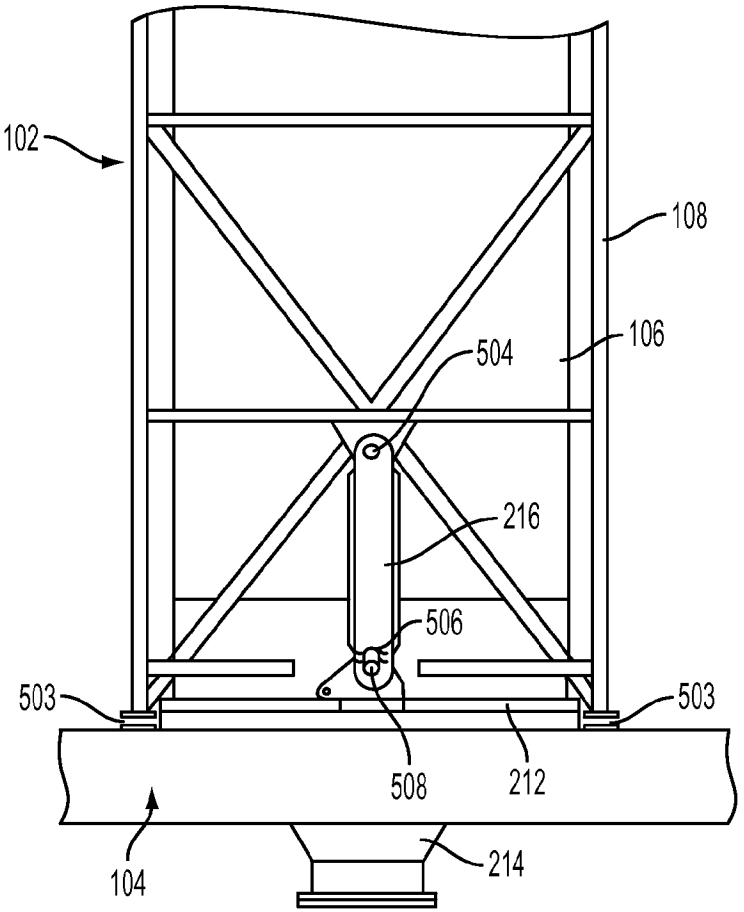
FIG. 5B is a side view of the skirt and cone region of FIG. 5A without a keeper plate according to an exemplary embodiment.

FIG. 5B is a side view of the skirt and cone region of FIG. 5A without the keeper plate according to an exemplary embodiment. As illustrated in FIG. 5B, the coke drum module 102 is positioned above the support pad 104. The cone 214 extends through and beneath the support pad 104. As illustrated in FIG. 5B, the third pin 510 (shown in FIG. 5A) and the compression member 302 (shown in FIG. 5A) have been removed. In FIG. 5B, the keeper plate 502 (shown in FIG. 5A) has been removed revealing a slotted hole 506. In a typical embodiment, the slotted hole 506 allows upward movement of the first pin 508 relative to the strut 216.

During installation, the skirt ring 212 of the coke drum 106 contacts the support pad 104 before the support frame 108 contacts the support pad 104. This aspect is illustrated in FIG. 5B by a gap 503. Thus, the weight of the coke drum 106 is relieved from the strut 216 and transferred to the support pad 104. As the support frame 108 continues to move in a downward direction, the first pin 508 moves in an upward direction within the slotted hole 506. Movement of the first pin 508 relative to the slotted hole 506 is visual confirmation that the strut 216 has been completely unloaded. Once the strut 216 is unloaded, the first pin 508, the second pin 504, and the strut 216 may be removed. As illustrated in FIG. 5B, the third pin 510 (shown in FIG. 5A) and the compression member 302 (shown in FIG. 5A) have been removed.

FIG. 5C is a side view of the skirt and cone region of FIG. 5A showing placement on a support pad according to an exemplary embodiment. As shown in FIG. 5C, the support frame 108 rests on the support pad 104. As previously discussed, initial contact of the coke drum 106 with the support pad 104 results in the weight of the coke drum 106 being relieved from the strut 216 and transferred to the support pad 104.

Further downward movement of the support frame 108 causes upward movement of the first pin 508 within the slotted hole 506. Such movement of the first pin 508 relieves tension from the strut 216 and facilitates removal of the first pin 508, the second pin 504, and the strut 216. After the strut 216 is removed, there is no rigid structural connection between the coke drum 106 and the support frame 108. Such an arrangement permits thermal expansion and contraction of the coke drum 106 during operation without causing damage to the support frame 108.

Figure 6:
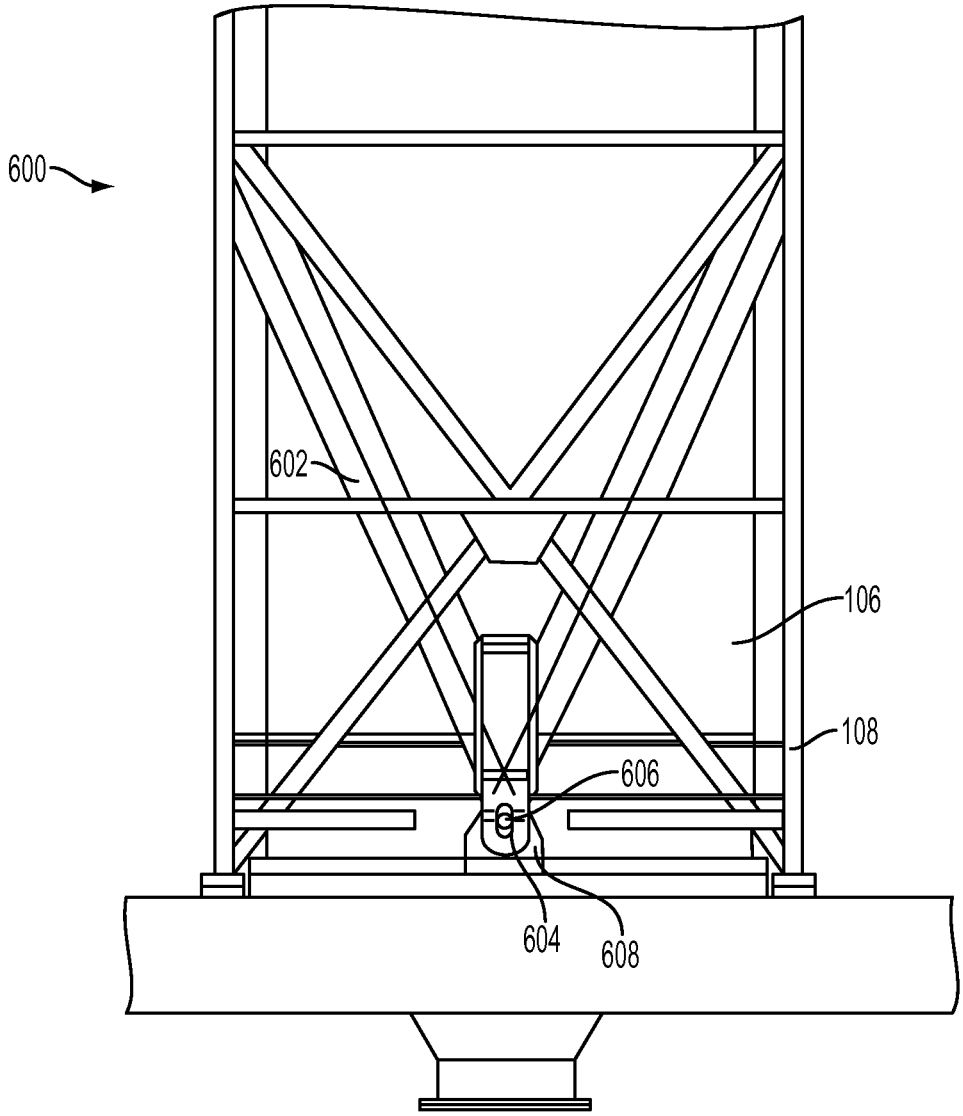
FIG. 6 is a side view of a coke drum module with a drum-support structure according to an exemplary embodiment.

FIG. 6 is the side view of a coke drum module with a drum-support structure according to an exemplary embodiment. A coke drum module 600 includes a drum-support structure 602 secured within the support frame 108. In a typical embodiment, the drum-support structure 602 supports at least a portion of the weight of the coke drum 106 when the coke drum module 102 is in either the vertical (operating) position, the horizontal (transport) position, or any other position. The drum-support structure 602 includes a slotted hole 604. A third pin 606 is placed through the slotted hole 604 and engages a lug 608 disposed on the skirt ring 212. In a typical embodiment, a keeper plate (not shown) is attached to the drum-support structure 602 above the third pin 606. The keeper plate conceals a portion of the slotted hole 604 and prevents movement of the third pin 606 relative to the slotted hole 604 prior to installation of the coke drum module 600 thus creating a rigid connection between the coke drum 106 and the support frame 108.

It should be noted that the keeper plate is removed prior to load transfer of the coke drum 106 to the support pad 104 thereby allowing the third pin 606 to move with respect to the slotted hole 604. The coke drum module 600 is then installed onto the support pad 104 in similar fashion to the process described in FIGS. 5A-5C with respect to the coke drum module 102. After installation, the third pin 606 and the drum-support structure 602 are removed. After the third pin 606, the drum-support structure 602, and the nozzle collar are removed, there is no rigid structural connection between the coke drum 106 and the support frame 108. Such an arrangement permits thermal expansion and contraction of the coke drum 106 during operation without causing damage to the support frame 108.

Figure 7:
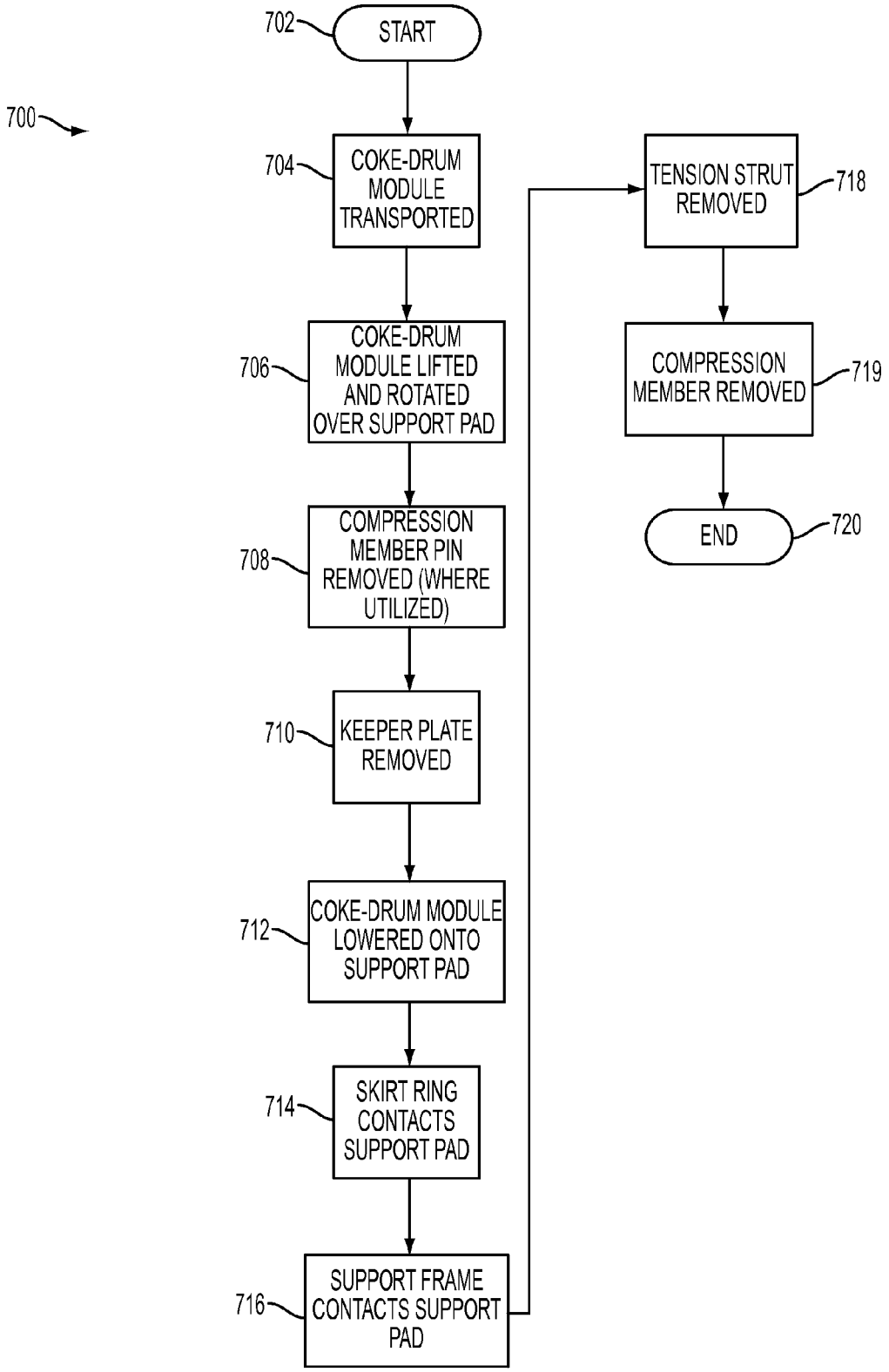
FIG. 7 is a flow diagram of a method of installing a coke drum module according to an exemplary embodiment.

FIG. 7 is a flow diagram of a method for installing a coke drum module according to an exemplary embodiment. A process 700 begins at step 702. At step 704, a coke drum module 102 is transported to an area where a coke drum system such as, for example, the coke drum system 100 is being constructed. During transportation, the coke drum module is oriented in the horizontal (transport) position as shown in FIG. 3. At step 706, the coke drum module 102 is lifted, via the first set of lifting lugs 208 and the second set of lifting lugs 304, and rotated into the vertical (operating) position overt the support pad 104. Rotation of the coke drum module 102 from the horizontal (transport) position to the vertical (operating) position transfers the weight of the coke drum 106 from the compression member 302 to the strut 216. Such transfer of the weight of the coke drum 106 unloads the compression member 302. At step 708, the third pin 510, securing the compression member 302, is removed. At step 710, the keeper plate 502 is removed revealing the slotted hole 506. At step 712, the coke drum module 102 is lowered onto the support pad 104.

At step 714, the skirt ring 212 contacts the support pad 104 causing the first pin 508 to move upwardly in the slotted hole 506 in response to further downward movement of the support frame 108. Upward movement of the first pin 508 in the slotted hole 506 relieves tension applied to the strut 216. At step 716, the support frame 108 contacts the support pad 104. At step 718, the first pin 508 and the strut 216 are removed. At step 719, the compression member 302 is removed Removal of the first pin 508, the strut 216, third pin 510, and the compression member 302 disconnects the coke drum 106 from the support frame 108 and permits thermal expansion and contraction of the coke drum 106 without damage to the support frame 108. The process 700 ends at step 720.

The advantages of the system and method described herein will be apparent to those skilled in the art. First, the coke drum module 102 ensures that a rigid connection between the coke drum 106 and the support frame 108, via the strut 216 and the compression member 302, is present during transportation of the coke drum module 102. However, when the strut 216 and the compression member 302 are removed, no rigid connection exists between the coke drum 106 and the support frame 108. Such an arrangement allows room for thermal expansion and contraction of the coke drum 106 during operation.

Second, the slotted hole 506 provides visual certainty that the coke drum 106 is fully supported by the support pad 104 prior to removal of the first pin 508. Such an arrangement improves safety and eliminates the possibility that the coke drum 106 could shift upon removal of the first pin 508. Third, lifting and manipulation of the coke drum module 102 via the first set of lifting lugs 208 and the second set of lifting lugs 304 eliminates the need for attachment and removal of lifting trunnions from the coke drum 106. Such an arrangement reduces risk of damage to the coke drum 106 during installation.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A coke drum module comprising:

a support frame;

a coke drum disposed within the support frame;

a removable tension strut disposed in the support frame for supporting a weight of the coke drum in a vertical direction;

a removable compression strut disposed in the support frame of the coke drum for supporting the weight of the coke drum in a horizontal direction;

wherein tension is at least partially relieved from the removable tension strut responsive to the coke drum contacting a support pad; and wherein, upon removal of the removable tension strut and the removable compression strut, the coke drum is not rigidly connected to the support frame thereby facilitating thermal expansion of the coke drum within the support frame.

2. The coke drum module of claim 1, wherein the removable tension strut is oriented generally parallel to a length of the coke drum.

3. The coke drum module of claim 1, wherein the removable tension strut is subjected to tension stress when the coke drum is oriented in a vertical direction.

4. The coke drum module of claim 1, wherein the removable compression strut facilitates transport of the coke drum module.

5. The coke drum module of claim 1, wherein the removable tension strut comprises a slotted hole formed therein, which slotted hole engages a pin disposed on the coke drum.

6. The coke drum module of claim 5, comprising a keeper plate disposed over the slotted hole, which keeper plate prevents movement of the pin within the slotted hole.

7. The coke drum module of claim 5, wherein movement of the pin within the slotted hole relieves the tension stress from the coke drum.

8. The coke drum module of claim 5, wherein contact of the coke drum with the support pad moves the pin within the slotted hole.

9. The coke drum module of claim 8, wherein the removable tension strut is removed after the coke drum contacts the support pad.

10. A coke drum module comprising:

a support frame;

a coke drum disposed within the support frame and connected to the support frame via a selectively de-coupleable connection, the selectively de-coupleable connection supporting a weight of the coke drum in a horizontal orientation and in a vertical orientation;

wherein, when coupled, the selectively de-coupleable connection facilitates transport of the coke drum module; and wherein, when the selectively de-coupleable connection is decoupled, thermal expansion of the coke drum is facilitated.

11. The coke drum module of claim 10, wherein the selectively de-coupleable connection comprises a removable strut coupled to the coke drum and the support frame.

12. A method of installing a coke drum module, the method comprising:

receiving the coke drum module comprising a coke drum and a support frame, a rigid connection being present between the coke drum and the support frame during transportation of the coke drum module, the coke drum module being in a horizontal orientation during transportation with a weight of the coke drum being supported by a compression strut;

lifting the coke drum module;

turning the coke drum module such that the coke drum is vertically oriented;

responsive to the coke drum contacting a support pad, at least partially unloading a tension strut coupled to the coke drum and the support frame;

positioning the support frame on the support pad; and removing the tension strut and the compression strut such that the rigid connection is not present after installation of the coke drum module.

13. The method of claim 12, wherein:

The tension strut supports a weight of the coke drum when the coke drum is oriented in a vertical direction; and the compression strut supports a weight of the coke drum when the coke drum is oriented in a horizontal direction.

14. The method of claim 12, wherein the coke drum comprises a pin that engages a slotted hole formed on the tension strut.

15. The method of claim 14, comprising restraining the pin within the slotted hole via a keeper plate.

16. The method of claim 15, comprising removing the keeper plate prior to coke drum contacting the support pad.

* * * * *